United States Patent [19]

Gordos

[11] 4,065,133

[45] Dec. 27, 1977

[54] GOLF CLUB HEAD STRUCTURE

[76] Inventor: Ambrose L. Gordos, 4301 E. 2nd St., Long Beach, Calif. 90803

[21] Appl. No.: 670,733

[22] Filed: Mar. 26, 1976

[51] Int. Cl.[2] ..... A63B 53/04

[52] U.S. Cl. ..... 273/167 E; 273/167 A; 273/173; 273/174

[58] Field of Search ..... 273/77 R, 80 R, 80.1, 273/80.2–80.8, 164, 167–175; D34/5 GC, 5 GH

[56] References Cited

U.S. PATENT DOCUMENTS

| | | | |
|---|---|---|---|
| D. 192,515 | 4/1962 | Henrich | 273/167 E X |
| 1,211,708 | 1/1917 | Hudson | 273/175 |
| 1,418,038 | 5/1922 | Tousey | 273/80 R |
| 1,582,836 | 4/1926 | Link | 273/167 H |
| 2,550,846 | 5/1951 | Milligan | 273/167 E |
| 3,233,905 | 2/1966 | Flom | 273/173 |
| 3,468,544 | 9/1969 | Antonious | 273/167 E X |
| 3,595,577 | 7/1971 | Hodge | 273/167 E X |
| 3,997,170 | 12/1976 | Goldberg | 273/164 |

FOREIGN PATENT DOCUMENTS

| | | | |
|---|---|---|---|
| 17,753 of | 1893 | United Kingdom | 273/175 |

*Primary Examiner*—Richard J. Apley
*Attorney, Agent, or Firm*—William C. Babcock

[57] ABSTRACT

A golf club that may be either a wood, iron or putter that has a number of spaced grooves formed in the head thereof that are substantially normal to the ball striking surface of the head. The grooves, when the club is swung, serve as passages or ducts through which air flows to impart improved flight stability to the head. The grooves on the bottom or sole of the club head, not only serve the above function, but minimize the surface of the head that may contact the ground surface just prior to the striking surface of the head impacting a golf ball. Due to this lessened sole surface, the frictional drag between it and the ground surface is lessened, and kinetic energy in the head that would otherwise be dissipated by frictional drag with the ground surface is transferred to the golf ball to increase the distance the latter is driven.

2 Claims, 6 Drawing Figures

GOLF CLUB HEAD STRUCTURE

BACKGROUND OF THE INVENTION

1. Field of the Invention

Golf club head structure.

2. Description of the Prior Art

In the past, numerous innovations have been devised and used in an attempt to improve the driving characteristics of golf clubs of the wood, iron and putter type. Woods have had various types of weights and inserts included as a part of the heads thereof, as well as bores that extend through the body of the head. Weight inserts are unsatisfactory in that they unduly heavy the head of a club to the extent it cannot be accelerated to impact a golf ball at maximum velocity. Bores extending through a club head in a direction substantially normal to the striking face of the head are unsatisfactory, in that, they lessen the weight of the club head in the area thereof that will impact the golf ball.

A major object of the present invention is to improve the driving characteristics of a golf club head of the wood, iron or putter type, without incurring the operational disadvantages of prior art devices of this type.

SUMMARY OF THE INVENTION

A golf club that may be either a wood, iron or putter that has a number of spaced grooves formed in the head thereof that are substantially normal to the ball striking surface of the head. The grooves, when the club is swung, serve as passages or ducts through which air flows to impart improved flight stability to the head. The passages, as air flows therethrough, act as directional vanes and tend to maintain the club head in a desired arcuate path to minimize twisting of the club and forcing the striking surface of the head to remain square throughout impact with the ball, hitting the ball solidly rather than glancingly. The grooves in the bottom surface of the club head not only serve the above described function, but in addition minimize the surface area of the head that may strike the ground surface just prior to the striking face of the head impacting the ball. Due to this lessened bottom surface, the frictional drag of the bottom surface with the ground surface is lessened to permit optimum kinetic energy to be transferred from the forwardly moving golf club head to the ball to increase the distance the latter travels.

A club head that has the lower portion of the striking surface of substantially the same radius of curvature as that of the golf ball it will strike forms a part of the present invention. This curved striking surface imports increased spin to the ball when the latter is struck, as well as importing a high trajectory to the ball. The curved striking surface provides greater surface contact when it impacts the ball, and as a result increased control is attained over the ball.

DESCRIPTION OF THE PREFERRED EMBODIMENT

Figure 1:
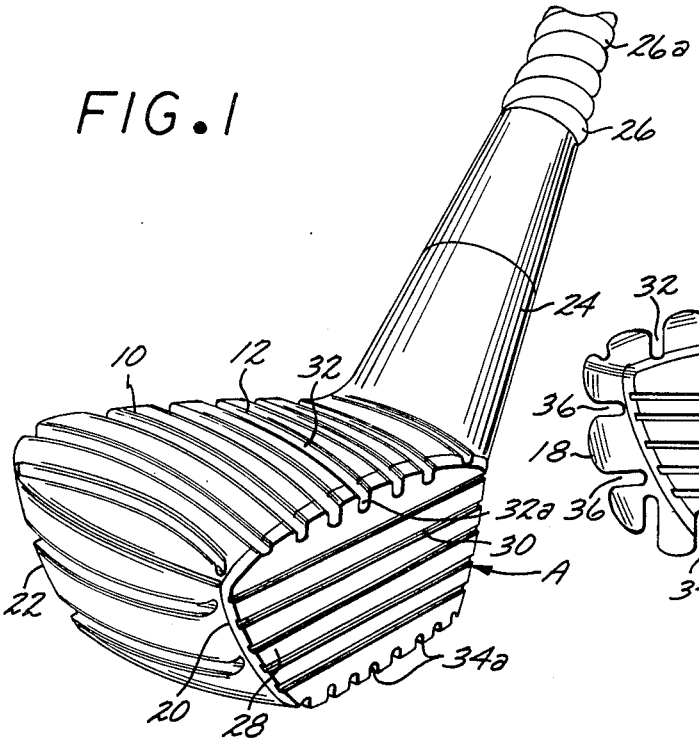
FIG. 1 is a perspective view of a driver of the wood type, and having a head that embodies the present invention.
Figure 2:
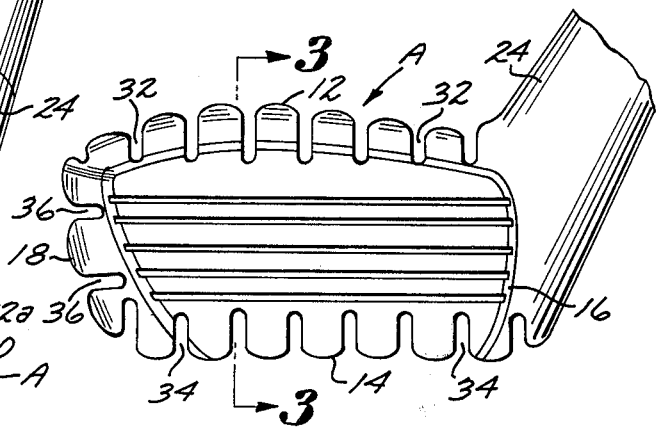
FIG. 2 is a front elevational view of the head shown in FIG. 1.
Figure 3:
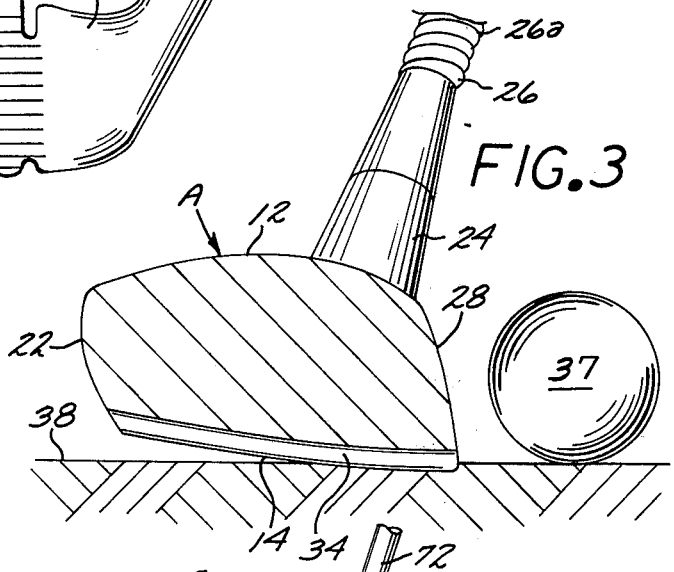
FIG. 3 is a transverse cross-sectional view of the golf club head shown in FIG. 2 taken on the line 3—3 thereof, and the head being illustrated as contacting the ground surface just prior to impacting a golf ball.

A golf club head A of the wood type is shown in FIGS. 1, 2 and 3, which club head has a body 10, defined by a top surface 12, bottom surface 14, first and second side surfaces 16 and 18, a leading surface 20, and a trailing surface 22. A tubular member 24 extends upwardly from the first side surface 16 and has a first end portion of a golf club shaft 26 disposed therein and bonded thereto. The shaft 26, if desired, may have a number of longitudinally spaced, circumferentially extending grooves 26*a* formed therein.

The golf club head A as illustrated in the drawing has a non-metallic golf ball striking plate 28 formed from a polymerized resin, ceramic material or the like secured to the leading surface 20. Plate 28 may have any desired recessed pattern 30 defined on the forward surface thereof.

The top 12, bottom 14 and second side wall surfaces 18 have a number of spaced, substantially parallel grooves 32, 34 and 36 formed therein. The grooves 32 and 34 are longitudinally aligned and in communication with groove extensions 32*a* and 34*a* formed in the top and bottom edge portions of the ball striking plate 28.

When the golf club, of which the head A forms a part, is swung through an arcuate path, air flows through the passages 32, 34 and 36 and the extensions 32*a* and 34*a* thereof. The passages, as air flows therethrough, act as a directional vane and tend to maintain the club head A in a desired arcuate path, thereby minimizing twisting of the club and permitting the ball striking plate 28 to squarely impact a golf ball 37, as shown in FIG. 3, rather than glancingly contacting the ball. Due to the controlled arcuate swing of the golf club embodying the head A, the likelihood of the golfer using the club hitting the ball with the center of the club face would be greatly increased. If the head A, as illustrated in FIG. 3, is contacting the ground surface 38 just prior to impact with the golf ball 36, the groove 34 lessens the bottom area 14 of the head A that will strike the ground surface 38 and be in frictional contact therewith. Thus, due to this lessened area of the bottom surface 14 that is in contact with the ground surface 38, there is less frictional drag between the head A and ground surface 38, and as a result, greater kinetic energy is transformed from the head A to the ball 36 upon impact with the latter and the ball being driven a greater distance than would otherwise occur. It will be particularly noted that the grooves 34 serve a dual function. First, that of tending to maintain the golf club head A in a predetermined arcuate path as the head moves therethrough and, secondly, in minimizing the surface 14 that contacts the ground surface 38 just prior to contact of the head A with the golf ball 37.

Figure 4:
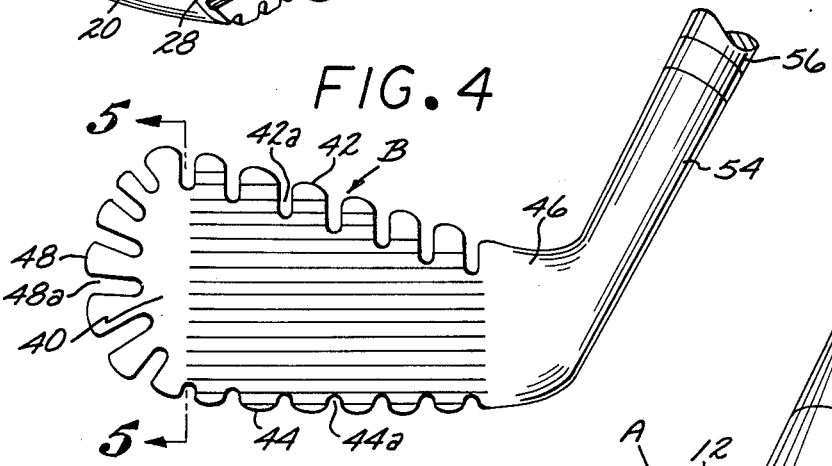
FIG. 4 is a fragmentary front elevational view of an iron, and illustrating the present invention incorporated into the head thereof.
Figure 5:
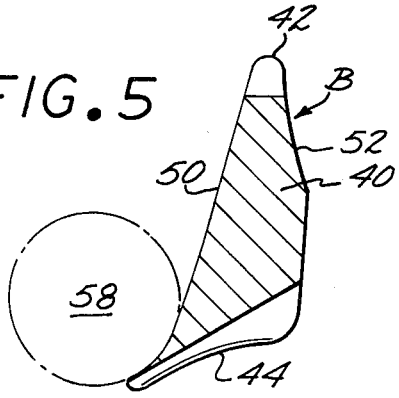
FIG. 5 is a transverse cross-sectional view of the head of the iron shown in FIG. 4 taken on the line 5—5 thereof, and the head of the iron illustrated as just impacting a golf ball shown in phantom line.

A second golf club head B is shown in FIGS. 4 and 5 that embodies the invention. Head B is an iron that includes a body 40 having a top 42, bottom 44, and first and second side surfaces 46 ad 48. The head B includes a leading ball contacting surface 50 and trailing surface 52. The ball contacting surface 50 includes a lower portion 50*a* that is of substantially the same radius of curvature as that of the ball 58 it will contact as best seen in FIG. 5. The portion 50*a* provides substantial surface contact with the ball 58 and assures not only better ball control, but also provides a distinct lift to the ball. A tubular member 54 projects upwardly from first surface 46 with the tubular member engaging an end portion of a shaft 56. The top 42, bottom 44, and second side surface 48 have a number of spaced, substantially parallel grooves 42*a*, 44*a*, and 48*a* formed therein, which grooves extend from the ball contacting surface 50 to the trailing surface 52. The grooves 42*a*, 44*a*, and 48*a*, serve the same function as the grooves described in conjunction with the first form A of the golf club head, namely, maintaining of the golf club head B in a desired arcuate path as the club of which the head B forms a part is swung by a golfer, and also the grooves 44*a* minimizing the bottom surface 44 that may contact the ground surface 38 just prior to the head B impacting a golf ball 58 shown in phantom line in FIG. 5.

Figure 6:
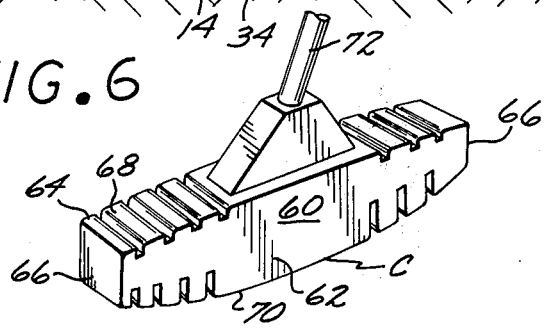
FIG. 6 is a perspective view of a putter head that embodies the invention.

A golf club putter head C is shown in FIG. 6 that includes a body 60 formed from a hard rigid material. The body 60 has a leading ball striking surface 62 and a trailing surface 64. The body 60 includes a pair of end surfaces 66, a top surface 68, and a downwardly convex surface 70. A number of spaced slots 68*a* ad 70*a* are formed in the surfaces 68 and 70 as may best be seen in FIG. 6. The putter head C includes an upwardly extending shaft connection 72.

The use and operation of the invention has been described previously in detail and need not be repeated.

I claim:

1. In combination with a golf club shaft having a first end portion, a golf club head having a top surface, a flat bottom surface, first and second side surfaces, a flat leading ball striking surface and a trailing surface, and a tubular member that extends upwardly from said golf club head and has said first end portion of said shaft situated within the interior thereof and bonded thereto, said golf club head being characterized by a plurality of spaced substantially parallel grooves defined therein that extend inwardly from each of said top, bottom and second side surfaces and said grooves on said top and bottom surfaces extending from said leading ball striking surface to said trailing surface, with said plurality of grooves as said club is swung having air flowing rearwardly therethrough and acting as directional vanes to maintain said club in a desired arcuate path to minimize twisting of the club and forcing said ball striking surface to remain normal to said arcuate path during impact with a golf ball, and said grooves in said bottom surface lessening the area of the latter that may contact the ground surface just prior to impact with a golf ball, and this lessened bottom surface lessening the frictional drag that results from contact between said bottom surface and ground surface wherein increased kinetic energy is transferred from said golf club heat to said golf ball to drive the latter, with the major portion of said club formed from wood and said ball striking surface defined by a non-metallic plate secured to the leading surface of said wood portion, and said grooves defined in said top and bottom extending through the top and bottom edge portions of said plate.

2. A golf club head as defined in claim 1 in which said shaft to which it is secured is characterized by having a number of longitudinally spaced, circumferentially extending grooves formed therein that serve as directional vanes when air flows therethrough that tend to augment the action of said grooves in said head in maintaining said head in a desired arcuate path as said golf club is swung by a user.

* * * * *